United States Patent [19]

Xie

[11] Patent Number: 5,042,720

[45] Date of Patent: Aug. 27, 1991

[54] SPRINKLER

[76] Inventor: Lun Xie, 2550 Washington Blvd., Arlington, Va. 22201

[21] Appl. No.: 526,439

[22] Filed: May 21, 1990

Related U.S. Application Data

[63] Continuation of Ser. No. 281,184, Dec. 8, 1988, abandoned.

[51] Int. Cl.[5] ..... B05B 3/06

[52] U.S. Cl. ..... 239/246; 239/251

[58] Field of Search ..... 239/246, 251, 252, 258, 239/261

[56] References Cited

U.S. PATENT DOCUMENTS 1,901,655 3/1933 Keys ..... 239/258 X

*Primary Examiner*—Andres Kashnikow

*Assistant Examiner*—Kevin P. Weldon

[57] ABSTRACT

Lawn sprinklers and related devices receive a fluid under pressure and convert its potential energy to kinetic energy; and their spreading range depends on the kinetic energy of the issuing jets. The object of present invention is a device of this class in which, however, the energy of a fluid from a single source is internally so redistributed, through pressure exchange, that different jets are made to issue from it at different kinetic energy levels, thereby making it possible for the sprinkling or spreading to cover a considerably wider area (for any given source pressure) and to do so more evenly.

1 Claim, 1 Drawing Sheet

SPRINKLER

This application is a continuation of application ser. no. 07/281,184, filed 12/08/88, now abandoned.

BACKGROUND OF THE INVENTION

Lawn sprinklers and related devices receive a fluid under pressure and convert its potential energy to kinetic energy; and their spreading range depends on the kinetic energy of the issuing jets. Conventional revolving sprinklers perform the conversion directly through their nozzles. Having a single moving part (the rotor), they are mechanically very simple, easy to manufacture and use, rugged, smooth and even in their spreading operation. Pulsing sprinklers achieve larger spreading radii. They do so, however, through a valve action whereby in each cycle a portion of the flow is brought to —and discharged at —a head approaching hammer pressure, higher than the total head of the source. These devices are, therefore, mechanically complicated, delicate, expensive to manufacture and maintain, and by the very nature, incapable of performing an even spreading operation.

A sprinkler combining the simplicity and spreading evenness of conventional devices with the spreading range of the pulsing ones would obviously serve a useful purpose.

SUMMARY OF THE INVENTION

The object of present invention is a device of this class in which the energy of a fluid from a single source is internally so redistributed, through pressure exchange, that different jets are made to issue from it simultaneously at different kinetic energy levels, thereby making it possible for the sprinkling or spreading to cover a considerably wider area (for any given source pressure) than with the conventional steady-flow devices of the same class, and to do so more evenly than with the pulsing ones.

The redistribution of energy is achieved by feeding the flow from the source into a free-spinning rotor and dividing it, inside the rotor, into two sets of subflows, a first set to be discharged out of the rotor through a first set of nozzles, a, and a second set of subflows to be discharged through a second set of nozzles, b, the locations and orientations of the nozzles of the two sets being such that the angular momentum about the rotor axis in the jets issuing through the nozzles a is of the opposite sign of the angular momentum in the jets issuing through the nozzles b. Under these conditions, if the source fluid enters the device without angular momentum, and if the rotor is truly free-spinning, the rotor will rotate at such an angular velocity that the total angular momentum of the issuing flow relative to the ground will be zero. (if an external torque is applied to the rotor —e.g., the torque effect of bearing friction —the rotor angular velocity will be that which will make the total angular momentum of the issuing jets equal to the applied torque). Thus, if the absolute magnitude of the angular momentum relative to the rotor is greater in the jets of the first set a than in those of the second set b, the rotor will rotate in the direction of the torque applied by the jets of the first set a. As a consequence, the subflows of the first set a will be de-energized, and the subflows of the second set b will be energized; and the total head of the emerging subflows of the first set a will be lower, and that of the subflows of the second set b will be higher, than that of the source flow. Where a subflow of the first set a separates from a subflow of the second set b in immediate proximity to the respective discharge nozzles, the energy transfer is effected through the essentially nondissipative work of the pressure forces which the two subflows exert on one another at their interface. The process is, therefore, much simpler and potentially more efficient than if it were effected by means of the best available machinery serving the same purpose.

DESCRIPTION OF PREFERRED EMBODIMENTS

Figure 1:
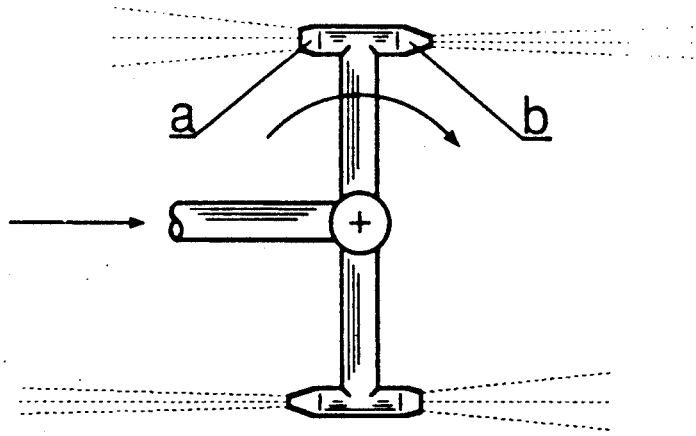
FIG. 1 illustrates the direction of rotation of the sprinkler.
Figure 2:
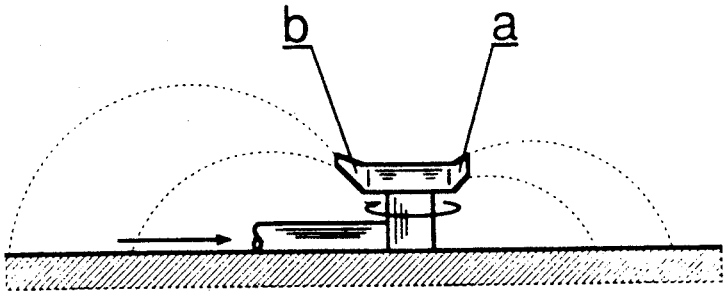
FIG. 2 illustrates the inclination of spray from each nozzle.
Figure 3:
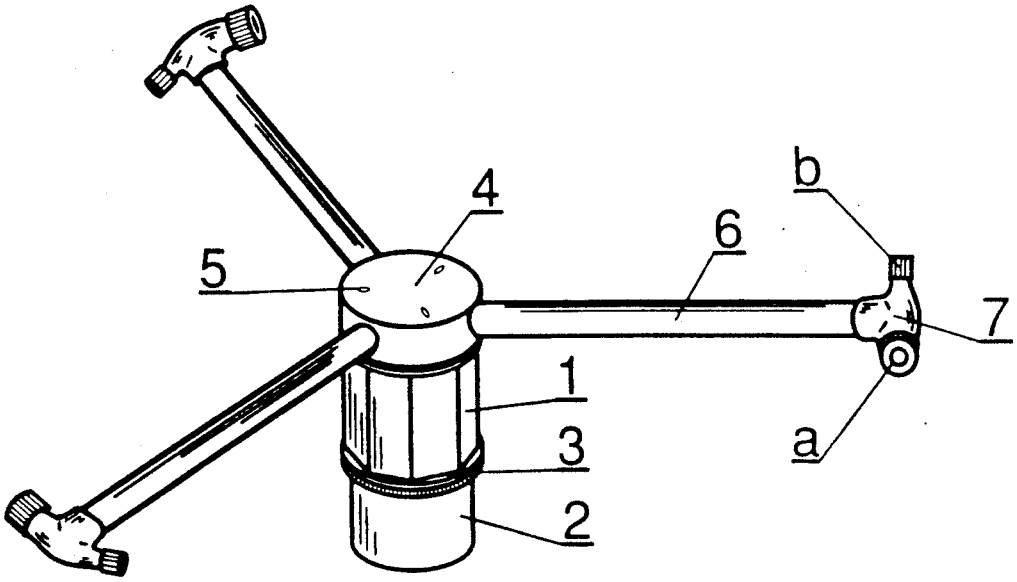
FIG. 3 shows a preferred embodiment of the invention.

A device operating on the basis of this mechanism is shown in FIGS. 1, 2 and 3 for the purpose of illustration. The device differs from conventional sprinklers in that its rotor carries not one but two sets, a and b, of discharge nozzles. The cross-sectional area of set a is larger than that of set b. The two sets differ also in their inclination to the plane of rotation and in the orientation of each issuing jet relative to the nozzle's tangential velocity, set b ejecting fluid in the direction of this velocity and set a in the opposite direction. By virtue of this arrangement, the driving torque produced by the jets issuing from nozzles a overcomes the resisting torque produced by the jets issuing from nozzles b, and causes the rotor to rotate. In this process, the total head of flows a is decreased, and that of flows b is increased. The latter flows will thus cover an annular area extending well beyond the range of conventional sprinklers operating at the same pressure, while the former will cover the area within this annulus.

With reference to FIG. 3 the sprinkler comprises a supporting stand 1 adapted to receive fluid under pressure through coupling 2 and seal 3. A rotor body 4 is bearing-mounted rotatable with respect to the axis of the supporting stand 1. The rotor body 4, arm ducts 6, and nozzle heads 7, form a rotor. Each nozzle head 7 consists of a discharge nozzle a and a nozzle b. Supplementary nozzles 5 may spread fluid to cover the area near the sprinkler.

The same concept may, of course, be applied to configurations comprising three or more sets of nozzles, and/or different radial positions of the different nozzles or sets thereof, and/or nozzle orientations whose projections on the plane of rotation are not all parallel to the nozzles' tangential velocities.

I claim:

1. A device for sprinkling or otherwise distributing a fluid comprising a supporting stand adapted to receive said fluid under pressure and to feed it continuously into a rotor having a central axis provided with two sets of discharge nozzles both sets of said discharge nozzles located equal distant from the rotor axis, a first set oriented to discharge a first portion of the flow of said fluid in a direction to drive said rotor to spin in a first direction, and a second set oriented to discharge a second portion of the flow of said fluid in a direction to drive said rotor to spin in the direction opposite to said first direction, the fluid being continuously supplied to both sets of nozzles through unobstructed passages, the nozzle areas and positions being such that the absolute magnitude of the total angular momentum relative to the rotor is greater in the jets issuing from the nozzles of said first set than in those issuing from the nozzles of said second set, whereby the rotor is made to spin in said first direction, the total head or stagnation pressure of said first portion of the flow is decreased to a lever lower than that of said source, and that of said second portion is increased to a level higher than that of said source.

* * * * *